US009902522B2

(12) United States Patent
Schinelli

(10) Patent No.: US 9,902,522 B2
(45) Date of Patent: Feb. 27, 2018

(54) CAROUSEL LABELING MACHINE FOR PRE-GLUED LABELS ON A RIBBON

(71) Applicant: P.E. LABELLERS S.p.A., Porto Mantovano (IT)

(72) Inventor: Nicola Schinelli, Curtatone (IT)

(73) Assignee: P.E. LABELLERS S.P.A., Mantovano (IT)

( * ) Notice: Subject to any disclaimer, the term of this patent is extended or adjusted under 35 U.S.C. 154(b) by 230 days.

(21) Appl. No.: 14/710,447

(22) Filed: May 12, 2015

(65) Prior Publication Data

US 2015/0239598 A1 Aug. 27, 2015

Related U.S. Application Data

(63) Continuation of application No. 14/114,366, filed as application No. PCT/EP2012/056915 on Apr. 16, 2012, now abandoned.

(30) Foreign Application Priority Data

Apr. 28, 2011 (IT) ..... VR2011A0081

(51) Int. Cl.

| | |
|---|---|
| ***B65C 9/42*** | (2006.01) |
| ***B65C 9/30*** | (2006.01) |
| ***B65C 9/18*** | (2006.01) |

(52) U.S. Cl.
CPC ..... *B65C 9/42* (2013.01); *B65C 9/1803* (2013.01); *B65C 9/30* (2013.01)

(58) Field of Classification Search
CPC ..... B65C 9/30; B65C 9/42; B65C 9/1803
See application file for complete search history.

(56) References Cited

U.S. PATENT DOCUMENTS 3,253,387 A * 5/1966 Schmermund ..... B65B 11/004 53/234
6,428,639 B1 * 8/2002 Oldenburg ..... B65C 3/08 156/351

* cited by examiner

*Primary Examiner* — Mark A Osele
*Assistant Examiner* — Christopher C Caillouet
(74) *Attorney, Agent, or Firm* — Thompson Hine LLP

(57) ABSTRACT

A carousel labeling machine for pre-glued labels on a ribbon is provided. The machine includes a label cutting and transfer drum fed by a roller for unwinding the label ribbon from a reel, and rotating in step with the carousel, in the sense that the unwinding roller provides the drum with the label intended for the container that rests on a specific receptacle of the carousel. A cutter of the drum is actuated so as to cut the label when a photocell sends a clearance signal as a consequence of the presence of the container. If at least one container is missing on the corresponding receptacle, the photocell sends a command to the unwinding roller to feed the label ribbon to the cutting and transfer drum at a speed reduced with respect to the normal speed.

3 Claims, 2 Drawing Sheets

CAROUSEL LABELING MACHINE FOR PRE-GLUED LABELS ON A RIBBON

This application is a continuation application of Ser. No. 14/114,366 to Nicola, filed on Oct. 28, 2013, which is the U.S. national phase of PCT Application No. PCT/EP2012/056915 filed on Apr. 16, 2012, which claims priority to Italian Patent Application No. VR2011A000081 filed on Apr. 28, 2011, the disclosures of which are incorporated in their entirety by reference herein.

The invention relates to a carousel labeling machine for pre-glued labels on a ribbon.

Carousel labeling machines are known which are designed to handle pre-glued labels printed consecutively on a ribbon wound on a reel, comprising a cutting and transfer drum fed by a roller for unwinding the label ribbon from a reel, with the optional interposition of a tensioning device.

The cutting and transfer drum rotates in step with the carousel, which is provided with receptacles each one of which is adapted to receive a container to be labeled which arrives by way of a star conveyor, in the sense that the unwinding roller provides the drum with the label intended for the container that rests on a specific receptacle of the carousel, and in that a cutter of the drum is actuated so as to cut the label when a photocell sends a clearance signal as a consequence of the presence of the container.

If one or more containers are missing from receptacles of the carousel, which can be caused by various factors, the machines built in accordance with the known art, thanks to a signal sent by the photocell, stop the unwinding roller and prevent actuation of the cutter so as to not supply the label corresponding to the missing container or containers, and then restart at full rotation speed when the supply of containers is resumed, but this, as will be better explained below, has negative effects on the motor of the unwinding roller and on the parts connected to it, because every restart at full rotation speed induces stresses that lead to breakage owing to fatigue.

This mode of operation is also badly suited to label ribbons which are made increasingly lighter and naturally less robust.

The aim of the present invention is therefore to provide a labeling machine in which the stresses of the motor of the roller for unwinding the label ribbon are reduced to a minimum, and which moreover can adopt label ribbons which are particularly light.

The set aim is achieved by a carousel labeling machine for pre-glued labels on a ribbon, according to the invention, characterized in that it comprises the characteristics according to the following claims.

Further characteristics and advantages will become more apparent from the description of a preferred, but not exclusive, embodiment of the invention, which is illustrated by way of non-limiting example in the accompanying drawings wherein.

Figure 1:
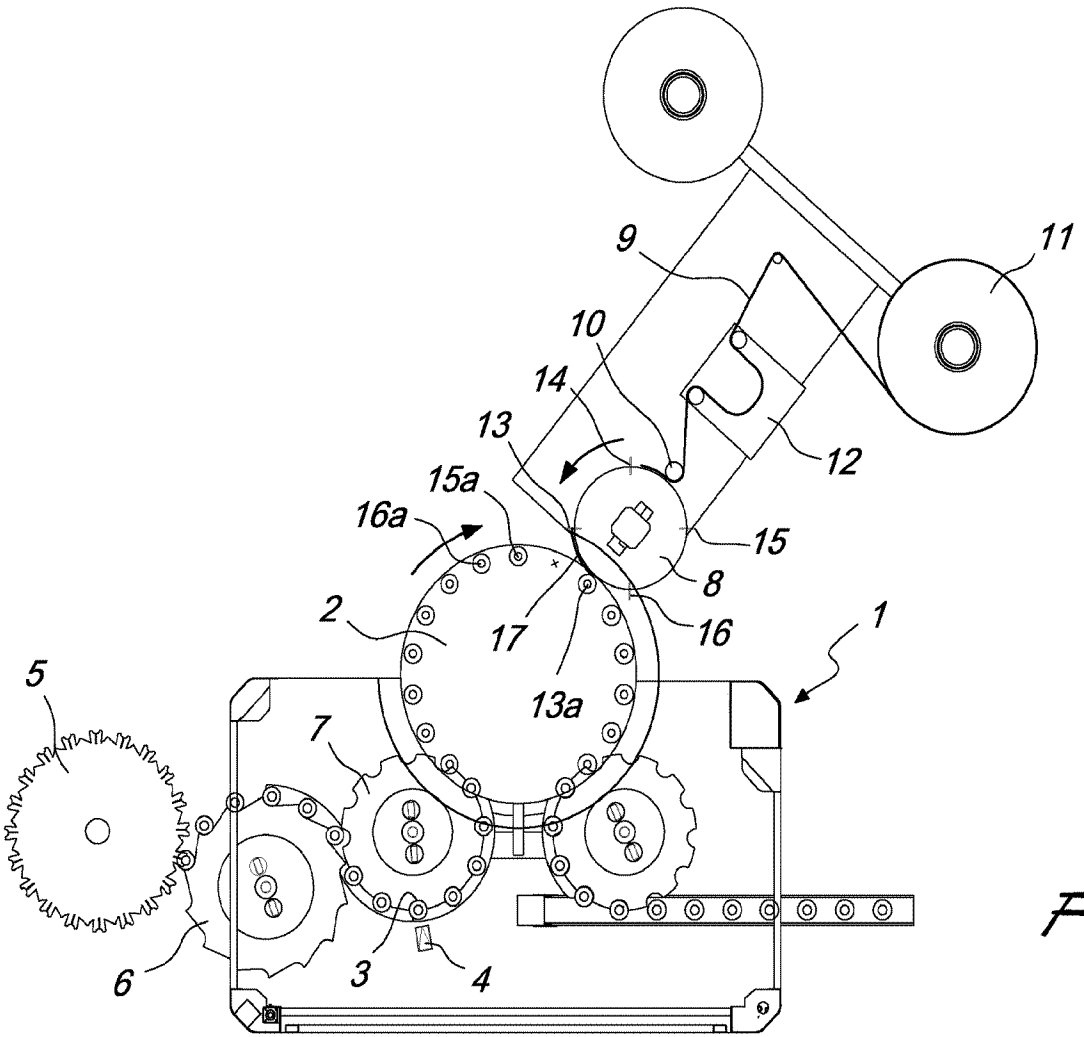
FIG. 1 is a view of a machine according to the state of the art.

With reference to the figures, the reference numeral 1 generally designates the labeling machine which forms part of a triblock with blowing and filling machines, comprising the carousel 2 provided with a plurality of receptacles for containers such as 3 which arrive, controlled by the photocell 4, by way of the star conveyors 5, 6, 7 which form a connection to the machine immediately preceding it in the triblock.

The machine 1 comprises the cutting and transfer drum 8 which will receive the label ribbon 9, on which pre-glued labels are consecutively printed, and which is fed by the roller for unwinding 10 from the reel 11, with interposition of the tensioning device 12. Present on the drum 8 are the cutters 13, 14, 15, 16 for cutting the label ribbon, which are actuated independently of each other.

The cutting and transfer drum 8, rotates in step with the carousel 2 in the sense that each one of the cutters 13, 14, 15, 16 present on the drum 8 is actuated to cut the label supplied by the unwinding roller 10 intended for the container that rests on a specific receptacle of the carousel 2 when the photocell 4 senses the presence of the container.

Thus the cutter 13 will cut the label 17 intended for the container 13*a*, the cutter 14 will cut the label intended for the container that comes after the container 13*a* if it is present, the cutter 15 will cut the label intended for the container 15*a*, and the cutter 16 will cut the label intended for the container 16*a*.

As has been said, FIG. 1 shows the machine according to the known art, and now the operation of this machine will be described.

The cutter 13 approaches the roller 10, and the photocell 4 senses the presence of the corresponding container 13*a*. Therefore it gives permission to the roller 10 to supply the label 17, and to the roller 13 to cut it from the ribbon 9.

Now the photocell 4 detects the lack of the container that should come after the container 13*a;* and consequently it stops the unwinding roller 10 and does not actuate the cutter 14. In this manner no label is arranged on the drum 8 between the cutters 13 and 14, congruently with the reported lack of the container.

Subsequently the presence of the container 15*a* induces a behavior of the photocell 4 which is the same as that described for the container 13*a*.

Figure 2:
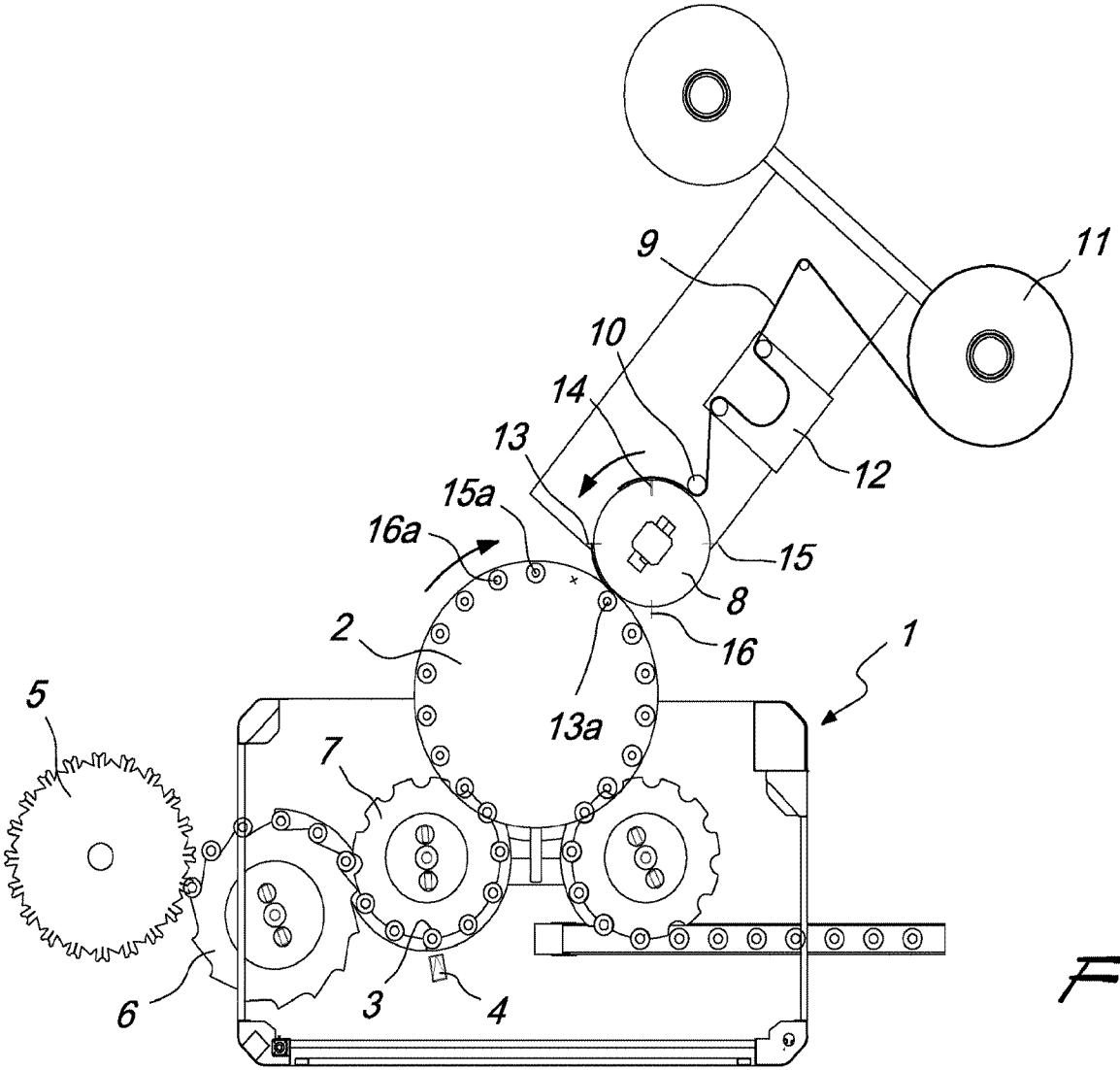
FIG. 2 is a view of a similar machine according to the invention.

The operation of the machine according to the invention is different and will now be described with reference to FIG. 2. The labeling of the container 13*a* is not changed.

Now the photocell 4 detects the lack of the container that should come after the container 13*a* and does not command the unwinding roller 10 to stop, but only to reduce speed with respect to its normal speed, and moreover it does not actuate the cutter 14.

The label is being prepared for the container 15*a*, i.e. for the first container after the missing one, with twice the time that is normally available, and therefore it is sufficient to reduce the speed of the unwinding roller 10 to a value that is half the normal value in order to complete the preparation of the label that will unfailingly end up on the container 15*a*, after having been cut by the cutter 15.

Basically the machine has profited from the lack of a container, i.e. of a negative event in the operation, by not stopping the unwinding roller 10 but only slowing it down with a reduction in stress of the corresponding motor and of the parts connected to it.

However, if not one but several containers are missing, then there are two possibilities.

A first possibility consists in reducing the rotation speed of the unwinding roller 10, so that it takes a uniform value, for example one third of the normal speed if two containers are missing.

A second possibility consists in stopping the unwinding roller 10 for the length of time coinciding with the lack of the first containers, and then restarting at a speed reduced to half the normal value, and therefore still advantageous for the resistance of the corresponding motor and connected parts, to coincide with the lack of the last container.

The invention described is susceptible of numerous modifications and variations, all of which are within the scope of the appended claims. Moreover, all the details may be substituted with other, technically equivalent elements.

The disclosures in Italian Patent Application No. VR2011A000081 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A method for labeling containers with pre-glued labels cut from a label ribbon on a carousel labeling machine, the method comprising:

unwinding from a reel by a roller a label ribbon on which pre-glued labels are consecutively printed and feeding by the roller the unwound label ribbon to a label cutting and transfer drum;

rotating said label cutting and transfer drum in step with the carousel of the carousel labeling machine, in the sense that the roller provides the drum with the label intended for the container that rests on a specific receptacle of the carousel and in the sense that a cutter of said drum is actuated so as to cut said label when a photocell sends a clearance signal as a consequence of the presence of said container, wherein if at least one container is missing on the corresponding receptacle, the photocell sends a command to said roller to feed the label ribbon to the cutting and transfer drum at a reduced speed with respect to the normal speed, such that the label intended for the first container that is present after the missing one can be fed to the next container that arrives after the time in which the missing container was to arrive, with activation of the corresponding cutter, wherein if a container is missing, the speed of the label unwinding roller is reduced to half the normal speed.

2. The method according to claim 1, wherein if two or more containers are missing, the speed of the label unwinding roller is reduced so as to have a uniform value relative to the number of containers missing.

3. A method for labeling containers with pre-glued labels cut from a label ribbon on a carousel labeling machine, the method comprising:

unwinding from a reel by a roller a label ribbon on which pre-glued labels are consecutively printed and feeding by the roller the unwound label ribbon to a label cutting and transfer drum;

rotating said label cutting and transfer drum in step with the carousel of the carousel labeling machine, in the sense that the roller provides the drum with the label intended for the container that rests on a specific receptacle of the carousel and in the sense that a cutter of said drum is actuated so as to cut said label when a photocell sends a clearance signal as a consequence of the presence of said container, wherein if at least one container is missing on the corresponding receptacle, the photocell sends a command to said roller to feed the label ribbon to the cutting and transfer drum at a reduced speed with respect to the normal speed, such that the label intended for the first container that is present after the missing one can be fed to the next container that arrives after the time in which the missing container was to arrive, with activation of the corresponding cutter, wherein if two or more containers are missing, the label unwinding roller is stopped for the entire time corresponding to the lack of containers detected, and restarts at a speed reduced to half the normal speed when another container is detected.

* * * * *